US006007075A

United States Patent [19]

Shum

[11] Patent Number: 6,007,075

[45] Date of Patent: Dec. 28, 1999

[54] CLAP SKATE WITH SPRING AND CABLE BIASING SYSTEM

[75] Inventor: Albert Shum, Portland, Oreg.

[73] Assignee: Nike, Inc., Beaverton, Oreg.

[21] Appl. No.: 08/931,488

[22] Filed: Sep. 16, 1997

[51] Int. Cl.[6] ..... A63C 1/00

[52] U.S. Cl. ..... 280/11.12; 280/11.22; 280/11.3; 280/11.27

[58] Field of Search ..... 280/11.22, 11.3, 280/11.27, 11.28, 615, 619, 11.18, 11.12

[56] References Cited

U.S. PATENT DOCUMENTS

| | | | |
|---|---|---|---|
| 56,369 | 7/1866 | Chormann . | |
| 330,133 | 11/1885 | Lapp . | |
| 1,597,792 | 8/1926 | Hoff et al. . | |
| 1,603,588 | 10/1926 | Eberle . | |
| 1,702,316 | 2/1929 | Ridgers . | |
| 2,093,915 | 9/1937 | Klevstad . | |
| 2,764,418 | 9/1956 | Shimizu | 280/619 |
| 2,950,118 | 8/1960 | Sharpe . | |
| 3,863,942 | 2/1975 | Burger . | |
| 3,963,251 | 6/1976 | Miano . | |
| 4,272,090 | 6/1981 | Wheat . | |
| 4,273,355 | 6/1981 | Storandt | 280/619 |
| 4,934,669 | 6/1990 | Bourdeau et al. . | |
| 5,232,231 | 8/1993 | Carlsmith | 280/11.22 |
| 5,257,793 | 11/1993 | Fortin | 280/11.22 |
| 5,342,071 | 8/1994 | Soo . | |
| 5,503,413 | 4/1996 | Belogour . | |
| 5,560,633 | 10/1996 | McGowan . | |
| 5,586,774 | 12/1996 | Dentale . | |
| 5,842,706 | 12/1998 | Chang | 280/11.22 |

FOREIGN PATENT DOCUMENTS

| | | | |
|---|---|---|---|
| 0 192 312 | 8/1986 | European Pat. Off. . | |
| 472837 | 12/1914 | France . | |
| 321977 | 6/1920 | Germany | 280/619 |
| 648702 | 7/1937 | Germany | 280/619 |
| 8602796 | 6/1988 | Netherlands . | |
| WO 89/11894 | 12/1989 | WIPO . | |

OTHER PUBLICATIONS

Carl Foster, Ph.D., Exercise Physiology, "What are Klapschaats," Speed Skating Times, Jan. / Feb. '97, p. 27.

Matthew E. Mantell, "Arrival of the Clap Skates Causes Some Commotion," The New York Times, Aug. 7, 1997.

*Primary Examiner*—J. J. Swann
*Assistant Examiner*—James S. McClellan
*Attorney, Agent, or Firm*—Banner & Witcoff, Ltd.

[57] ABSTRACT

A skate primarily intended for speed skating. The skate is of the clap type wherein the blade is pivotally movable with respect to the boot. A coupling assembly includes top and bottom linkages pivotally attached to one another and is disposed to permit pivotal movement between the blade and the boot. The upper linkage is attached to the boot and the lower linkage is attached to the blade. A biasing arrangement moves the linkages into a closed position. The biasing arrangement includes a spring, a pulley, and a roller. The spring attached at its fore end to the bottom linkage. The cable is attached to the aft end of the spring, is guided around the pulley, and is attached to the top linkage. A significant portion of the biasing arrangement is shielded within the bottom linkage for protection and to provide a compact and effective design. The orientation and features of the biasing arrangement and guide surfaces of the linkages minimizes torsional forces on the coupling assembly, minimizes wear, and increases spring tension forces.

19 Claims, 10 Drawing Sheets

CLAP SKATE WITH SPRING AND CABLE BIASING SYSTEM

FIELD OF THE INVENTION

The present invention relates to skates primarily used in speed skating. More specifically, the present invention relates to "clap skates" which are skates that permit the skater to pivot the shoe portion of the skate with respect to the ground or ice engaging portion to enhance performance.

BACKGROUND OF THE INVENTION

In the sport of ice speed skating, the overwhelming majority of skaters for many years have used a type of skate where the foot retaining portion (i.e., the boot) is fixedly mounted to an elongated blade by forward and rearward pedestals. To use these conventional skates effectively, a skater must learn to maintain his ankle in a rigid position while placing pressure on his heel and pointing his toes skyward to keep the blade parallel to the ice during stride and obtain relatively long strides. However, skating in this fashion restricts the ankle's role in propulsion, virtually omits the power of the ankle and the calf muscles from the stride, and causes the blade to leave the ice before full leg extension is complete. Further, this conventional method of skating causes the leg muscles to be tense through most of the stride, creating a stiff, robotic effect that inhibits optimum performance.

A "clap skate" differs from a conventional skate in that skater's boot is pivotable forwardly with respect to its blade about a pivot axis transverse to the length of the blade. Examples of existing clap skates are shown in FIGS. 1–2, FIG. 3, and in European Patent Application No. 192,312. In clap skates, the forward portion of the boot is pivotally attached to the blade while a rearward portion of the boot can be tilted forwardly as it moves about an established front pivot axis. A pivot and biasing arrangement allows the heel of a skater's boot to rise and fall and biases the blade with respect to the boot, which keeps the blade in contact with the ice for the length of the skater's stride. These pivot and biasing arrangements allow the skater to take longer and more fluid strides, and allows all the leg muscles to work in a fluid, more efficient manner, resulting in an economy of motion and faster skating times.

The separating heel design of the clap skates also allows the skater to add the power of his calf muscles to his stride, while keeping the blade on the ice. In essence, it provides an extra set of muscles for the skater to use. The skater's legs can therefore act more like that of a jumper, who flexes the ankle, pushing off the heel, then the ball of the foot and then the toes. This makes the strides longer and much more powerful.

There are two ways to use clap skates, either of which achieves benefits over the conventional skates. One way is for the skater to sit just as deep as he ordinarily would, but get a longer push. The other alternative is for the skater to sit higher, but get the same push. Sitting higher is advantageous because it almost always results in better endurance.

One prior art clap skate design is shown in FIGS. 1 and 2. Skate 10 includes a boot 12 and a blade 14 which is held in an elongated tubular blade holder 15. The bottom of the boot 12 includes fore and aft mounts 16, 18, respectively. Boot 12 is coupled to an upper frame member 20 by attaching the bottom of mounts 16, 18 to upper frame member 20.

A pair of laterally spaced parallel brackets 22 are attached to blade holder 15. A pin 24 extends through parallel holes in the brackets 22 and a hole in the forward portion of the upper frame member 20. The rearward portion of the upper frame member 20 is not attached to the blade 14 so that the upper frame member 20 and the boot 12 can pivotally move with respect to the blade 14 about the axis of the pin 24. The upper frame member 20 is laterally guided with respect to the blade 14 and blade holder 15 only at its fore end by opposing inner wall surfaces of laterally spaced parallel brackets 22.

On both the lateral and medial sides of the blade 14, a spring 26 is connected at its ends to projections 28, 30 on the parallel brackets 22 and the upper frame member 20 respectively. Springs 26 are pretensioned so that the blade 14 and blade holder 15 are biased towards a closed position as shown in FIG. 1. As the skater flexes his ankle during stride, the boot 12 and upper frame member 20 pivots with respect to the blade 14 and blade holder 15 to move from the closed position, as shown in FIG. 1, to an open position, as shown in FIG. 2. The springs 26 return the blade 14 and blade holder 15 to the closed position when the blade 14 is lifted off the ice. A stop 32 is located on the top of an aft pedestal mount 33 which is attached to the blade holder 15 aft of brackets 22 so that the upper frame member 20 stops in a predetermined position.

Another prior art clap skate design is shown in FIG. 3 and is designated by reference numeral 40. The primary difference between skate 40 of FIG. 3 and skate 10 of FIGS. 1 and 2 is that the coil springs 26 of skate 10 have been eliminated, and a torsional spring 42 has been added adjacent the front pivot axis 44. In addition, in lieu of stop 32, a hollow cone 46 is mounted on the rearward portion of the boot 47 and interfaces with a cone shaped projection 48 mounted to the blade holder 49.

While providing advantages over conventional fixed skates, these and other prior art clap skate designs include a number of drawbacks. Problems and drawbacks exhibited by prior art clap skates are related to the spring biasing systems used and other aspects of the skates. With respect to the spring biasing systems, drawbacks may reside in low return spring rates and/or erratically controlled spring forces. Other problems and drawbacks include poor lateral stability between the boot and blade which can result in excessive and undesirable torques on the hinge and blade, especially during cross-over strides when the skater is going around turns. Further, none of the prior art skate designs provide structure permitting simple adjustment of the biasing force. Moreover, the structural arrangements in the prior art skates that are used to stop the members as the blade moves to the closed position create a single point shock force which is felt by the skater. A few examples of the drawbacks are described below with respect to skates 10 and 40 of FIGS. 1 and 2 and FIG. 3, respectively.

In skate 10 of FIGS. 1 and 2, two springs 26 are used to apply the biasing force to the blade and blade holder to move them to the closed position. However, this design has drawbacks associated with the spring design and interaction with other elements of the skate. As can be seen from FIGS. 1 and 2, the spring forces are directly applied to the upper frame member 20 at projections 30—a point located slightly less than halfway from the pivot axis 24 to the aft end of the upper frame member 20 and also slightly less than halfway from the pivot axis 24 to the connection point between aft boot mount 18 and the upper frame member 20. This feature, in combination with the feature that the upper frame member 20 is laterally guided with respect to the blade 14 and blade holder 15 at its fore end by opposing inner wall surfaces of laterally spaced parallel brackets 22 and at its rear end only during the very end of its pivotal motion towards its closed position by opposing side surfaces of stop 32, causes high lateral torsional forces to be applied at the hinge, i.e., pin 16 and laterally spaced parallel brackets 22, whenever the force applied to the upper frame member 20 by the skater is not exactly coincident with blade 14. These lateral forces are undesirable because they cause the aft end of the upper frame member 20 to be laterally displaced from the longitudinal axis of the blade 14 causing inefficient transfer of the skater's thrusting force to the blade and poor lateral stability. It may also lead to damage of the laterally spaced parallel brackets 22 or the pin 24. Moreover, these undesirable forces are the highest at the most critical times of race, when the skater is going around turns and crossing-over—where the races are most often won and lost.

Another drawback in this design is that the connection points between the ends of the springs 26 do not take full advantage of the length that the spring could theoretically extend. This results in a low spring return rate and/or the use of unnecessarily large springs. Further, there is no way for the skater to adjust the spring return rate without having to replace the spring. This is undesirable because skaters would have to carry a collection of springs if they wanted to gain a competitive advantage by adjusting the spring return rate due to conditions of the ice surface.

Yet another drawback of this design is that two springs are required to produce a balanced biasing force along the longitudinal axis of the blade. Further, as the springs are medially and laterally spaced from the central longitudinal axis of the blade, their inherent positioning exposes the springs and makes them especially susceptible to physical damage in use and in transportation.

In the design as shown in FIG. 1, when the blade 14 is in the closed position, the skater's thrust force is transferred to the blade 14 and blade holder 15 in only two small areas—at the hinge and at the stop 32. This results in the skater's thrust force being transferred at high and possibly uneven concentrations. Moreover, because stop 32 includes only a small surface to apply the stopping force, this stopping force is highly concentrated. This can lead to repetitive shock forces being absorbed by the skater on his heel and a louder distracting clapping force generated each time the blade 14 and blade holder 15 moves to their closed position.

Skate 40 of FIG. 3 includes many of the same or similar drawbacks and exhibits many of the same or similar undesirable qualities as skate 10 shown in FIGS. 1 and 2. Spring 42 of skate 40 applies the biasing force to the blade and blade holder to move them to the closed position. However, the spring force is applied immediately adjacent the pivot pin by torsion spring 42. This results in undesirable lateral torsional forces which are even greater that those of skate 10 of FIGS. 1 and 2 because the biasing force is applied at or immediately adjacent the hinge pin.44. As described above, this can cause inefficient transfer of the skater's thrusting force to the blade and poor lateral stability, and it may also lead to damage of the laterally spaced parallel brackets 22 or the pin 24. Further, the torsional spring 42 does not take full advantage of the length that the spring could theoretically extend. There is also apparently no way for the skater to adjust the spring return rate without having to replace the spring. Skate 40 is also similar to skate 10, in that the skater's thrust force is transferred to the blade 14 and blade holder 15 in only two small areas resulting in the skater's thrust force being transferred at high and possibly uneven concentrations, and a highly concentrated stopping force.

SUMMARY OF THE PRESENT INVENTION

In view of the foregoing, it is a principal object of the present invention to provide an improved clap skate that incorporates all advantages exhibited by clap skates including increased stride length and use of lower leg muscles, and overcomes drawbacks and disadvantages associated with prior art clap skates.

The skate according to the present invention includes an element for holding a foot of a skater and a supporting surface engaging assembly for contacting a supporting surface and transferring a propulsion force applied by the skater from the foot holding element to the supporting surface. The skate also includes an assembly coupling the foot holding element and the supporting surface engaging assembly such that the foot holding element and the supporting surface engaging assembly are pivotally movable with respect to each other to move the supporting surface engaging assembly between open and closed positions relative to the foot holding element. The supporting surface engaging assembly is biased by a biasing device to move it into its closed position. The biasing device includes a spring and a cable, both having first and second ends. The first end of the spring is attached to one of the foot holding element and the supporting surface engaging assembly, while the second end of the spring is attached to the first end of the cable. The second end of the cable is attached to the other of the foot holding element and the supporting surface engaging assembly. The biasing device according to the present invention is compact and easily adjustable. It is also shielded from external forces and aligned on center with the movement of the upper linkage of the coupling assembly. The spring and fore portion of the cable are generally horizontally disposed and parallel with the longitudinal axis of the supporting surface engaging assembly and the bottom linkage of the coupling assembly.

The biasing device according to the present invention evenly applies and distributes a high spring force to the foot holding element, the coupling assembly and the supporting surface engaging assembly. The biasing device also includes a cable length adjustment mechanism for adjusting the effective length of the cable and the biasing force.

The coupling assembly includes first and second linkages made from different materials and pivotally attached to one another. The first linkage includes an arcuate stopping surface for limiting the movement of and guiding the second linkage to reduce torsional forces experienced by the linkages and the pivot arrangement.

These and other objects and features of the invention will be apparent upon consideration of the following detailed description of preferred embodiments thereof, presented in connection with the following drawings in which like reference numerals identify like elements throughout.

DETAILED DESCRIPTION

Figure 1:
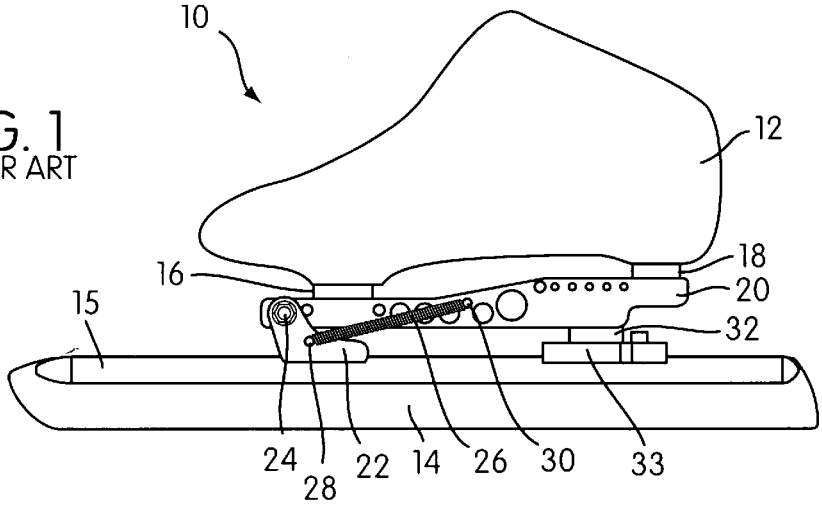
FIG. 1 PRIOR ART
FIG. 1 is a side elevational view of a prior art clap skate design with the boot and the blade shown in a first position.
Figure 2:
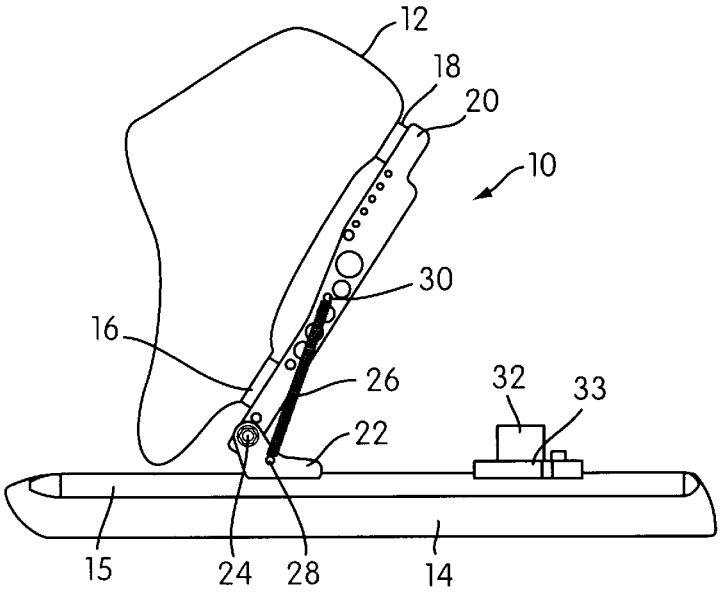
FIG. 2 PRIOR ART
FIG. 2 is a side elevational view of a prior art clap skate design with the boot and the blade shown in a second position.
Figure 3:
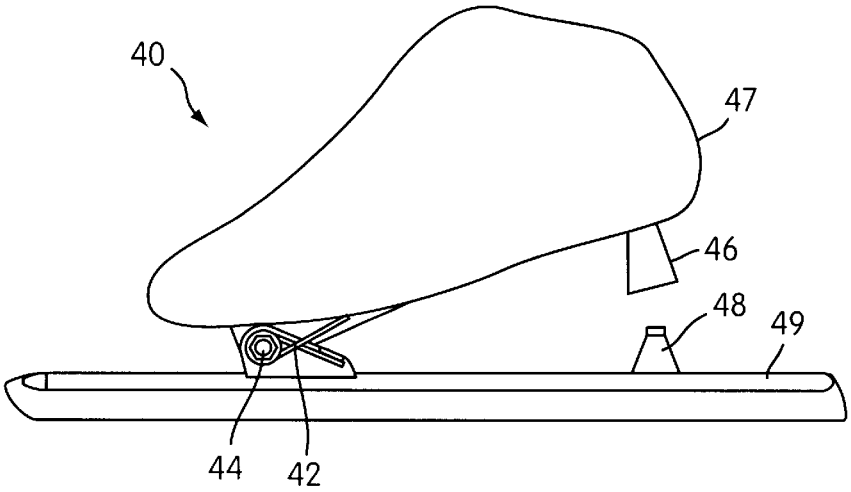
FIG. 3 PRIOR ART
FIG. 3 is a side elevational view of a second prior art clap skate design.

In the present invention, as pictured in FIGS. 4–11, a clap skate is designated generally by reference numeral 50. Skate 50 is preferably of the type used for speed skating and is of the clap skate type, i.e., where skater's boot is pivotable forwardly with respect to its supporting surface engaging structure, e.g., its blade, about a pivot axis transverse to its ground supporting structure. In sum, the skate 50 includes a boot 52 or a foot holding element for securely holding a skater's foot, a supporting surface engaging unit 53, and an articulating coupling and biasing system 56 which couples the boot 52 to the supporting surface contacting propulsion unit 53, permits the skater to forwardly pivot his foot with respect to the supporting surface contacting propulsion unit 53, and automatically returns the supporting surface contacting propulsion unit 53 to a closed position with respect to the boot 52 in the absence of an applied force by the skater.

Figure 11:
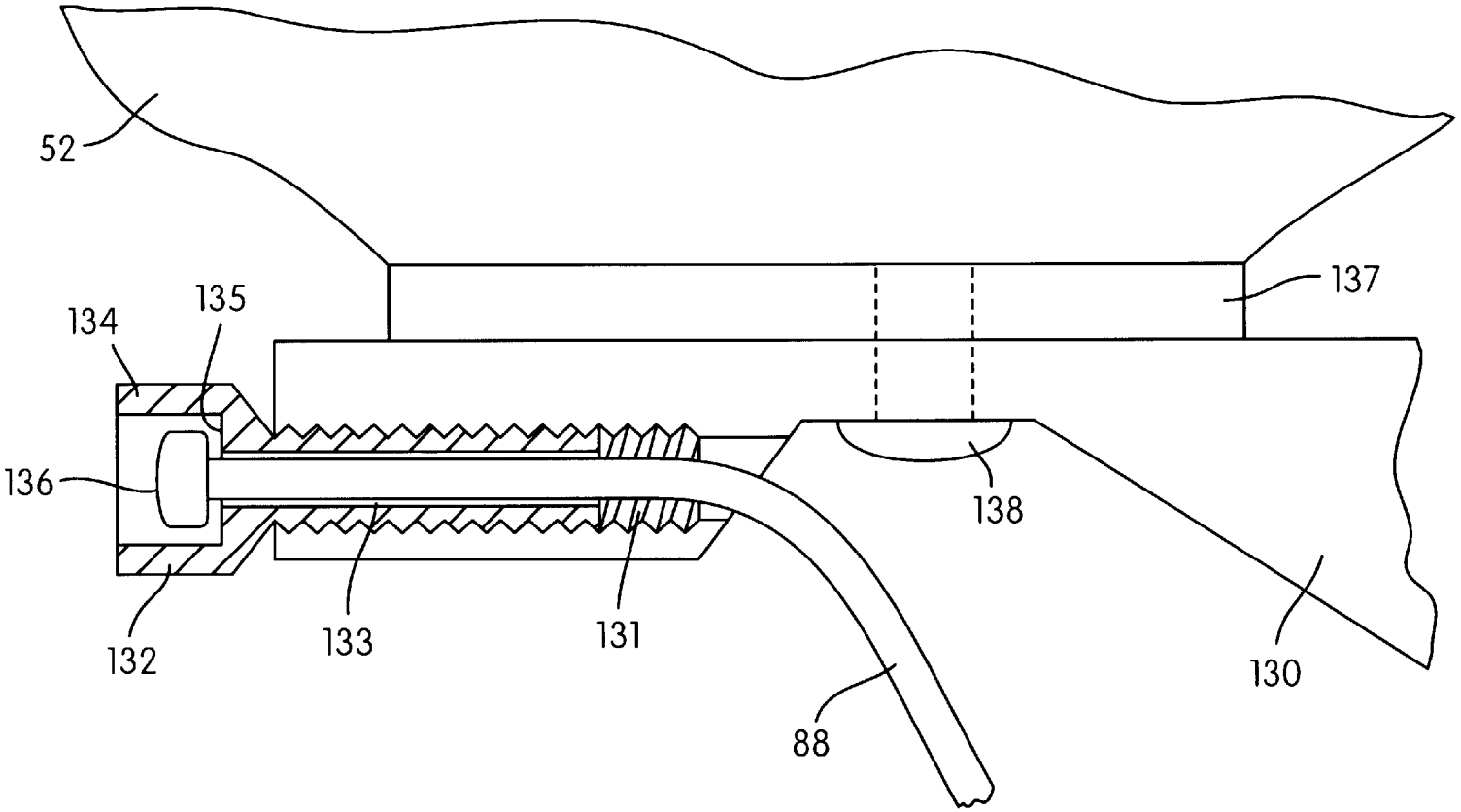
FIG. 11 is a side view of an alternative cable length adjustment system.
Figure 12:
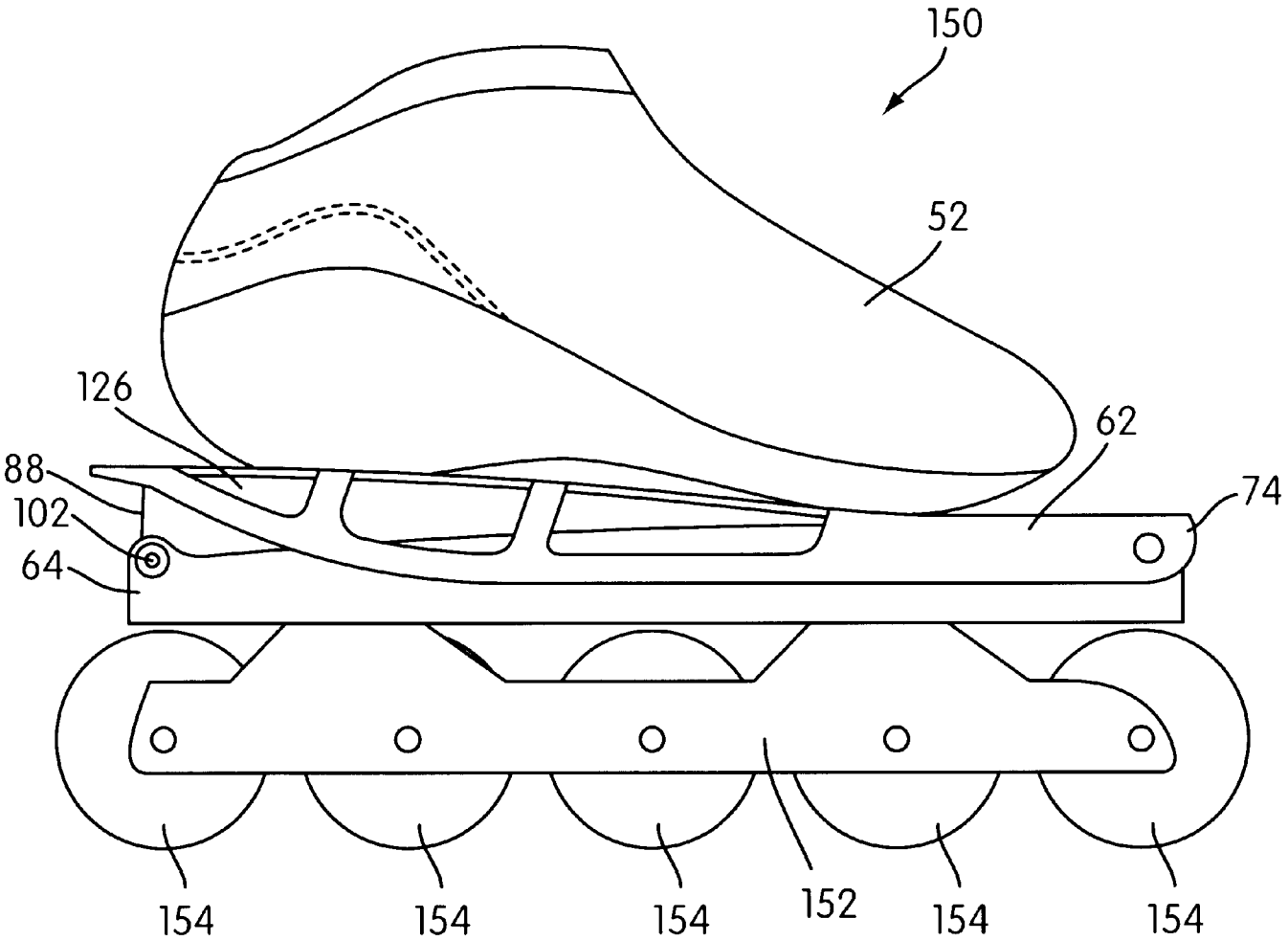
FIG. 12 is a side elevational view of the skate of the present invention shown with a chassis and wheels for in-line skating.

In FIGS. 4–11 and in the majority of the following specification, skate 50 is primarily shown and described as being adapted for ice skating. Accordingly, supporting surface engaging unit 53 is depicted and described as being a blade assembly 54 having a blade or runner 58 and a blade holder 60, and is intended to contact an ice surface and transmit a force to the ice surface to propel the skater. However, the current invention is not limited to such an application, and the skate may be adapted for an in-line wheeled skate. In such an event, supporting surface engaging unit would include a chassis having a longitudinal frame and a plurality of in-line wheels each rotatably mounted about a respective axis transverse to the longitudinal frame, and would be intended to contact hard surfaces normally used for in-line skating, e.g., cement or concrete. This embodiment is shown in FIG. 12 and described hereinafter.

As shown in FIGS. 4–11, articulating coupling and biasing system 56 preferably includes a top linkage 62, a bottom linkage 64, and a biasing return system 66 which biases the top linkage 62 and bottom linkage 64 into a closed position with respect to each other. Top linkage 62 is fixedly mounted to boot 52 and bottom linkage 64 is fixedly mounted to blade 58 such that the articulating coupling and biasing system 56 permits pivotal movement between the boot 52 and the blade 58 and biases the blade 58 into a predetermined and closed position with respect to the boot 52.

Figure 4:
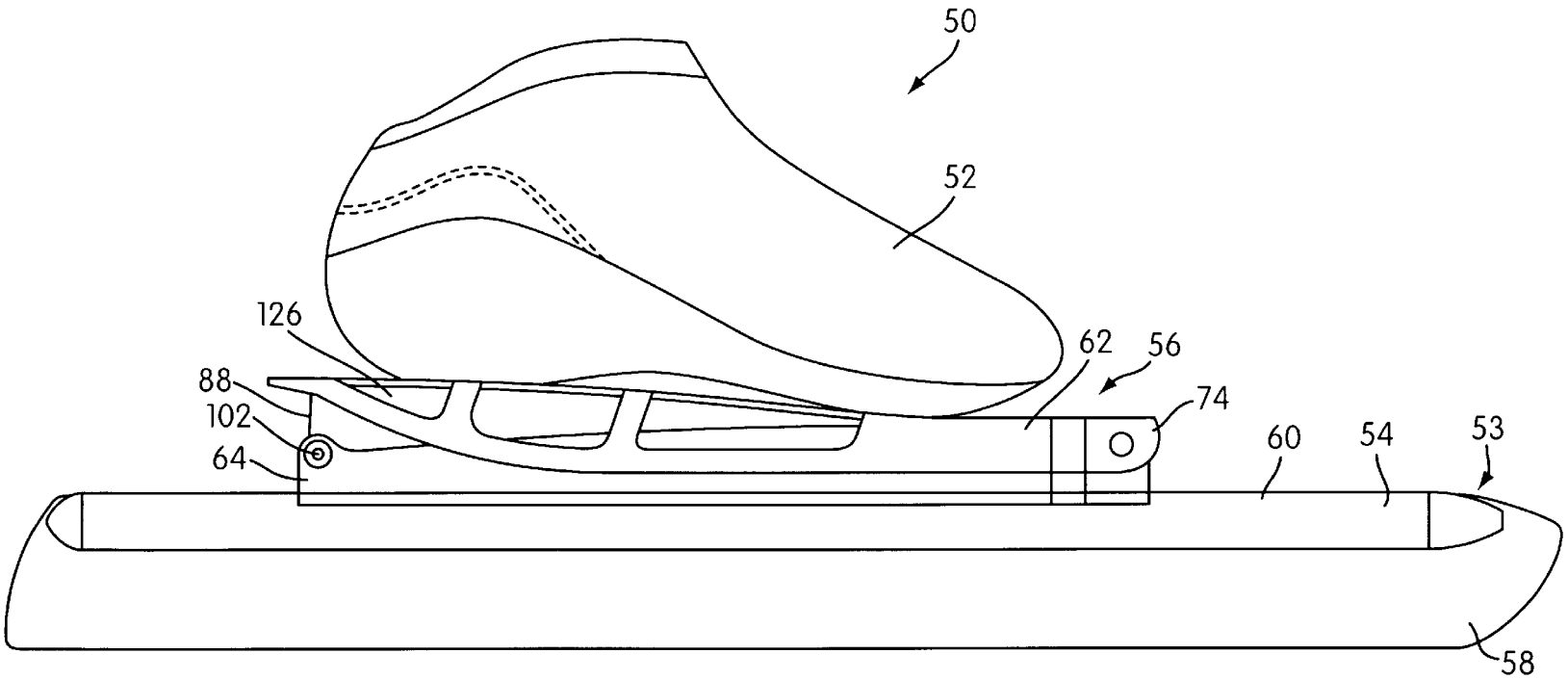
FIG. 4 is a side elevational view of the skate of the present invention shown with a blade for ice skating.

More specifically, top linkage 62 includes a top wall 61 having fore and aft longitudinal slots 67 and 68 permitting screws, e.g. screw 138, to be screwed into tapped holes in fore and aft mounts 137, respectively, on the bottom of boot 52. This physically attaches the top linkage 62 to boot 52. The longitudinal slots 67 and 68 permit top linkage 62 to be attached to boots of varying size. This arrangement also permits removal and replacement of boot 52 without the need to discard the entire skate. As can be seen in FIG. 4, top wall 61 of top linkage 62 has a slight rise in it along the longitudinal axis as it extends rearwardly. This compensates for a slight increase in height, e.g., 1 cm., between the fore and aft mounts on boot 52 which is common on many boots.

Bottom linkage 64 preferably includes a bottom wall 71 having fore and aft slots, not shown, for removably awing articulating coupling and biasing system 56 to blade assembly 54. Blade assembly 54 includes fore and aft mounts 63 and 65 which are welded, e.g., silver soldered, to the top of blade holder 60. The fore and aft mounts 63 and 65 are tapped such that common hardware, e.g., screws, can extend through the fore and aft slots in bottom linkage 64 to attach articulating coupling and biasing system 56 to blade assembly 54. This arrangement is beneficial as the repeated sharpening of the blade 58 causes it to wear down, and this arrangement permits removal and replacement of blade assembly 54 without the need to discard the entire skate. In the preferred embodiment as shown, bottom linkage 64 is substantially parallel to blade 58 and blade holder 60.

Adjacent their forward ends, top linkage 62 and bottom linkage 64 are pivotally mounted to each other such that bottom linkage 64 and blade assembly 54 are pivotally movable with respect to boot 52 about an axis 69 transverse to the longitudinal axes of blade 58, blade holder 60, and linkages 62 and 64. This pivotal coupling preferably includes oil impregnated cylindrical flange bearings 70 located in both ends of a cylindrical transverse bore 72 in the front of bottom linkage 64. Top linkage 62 includes left and right opposing side walls 73, the forward-most ends of which include forwardly extending ears 74 having aligned transverse holes 76 therein. Holes 76 in the inner surfaces of ears 74 are aligned with holes 78 in flange bearings 70, and a through-bolt 80 with threads at its end extends through the aligned holes 76 and 78. A nylon lock nut 82 is threaded onto bolt 80 to keep it retained in its position. This pivotal connection exhibits a low coefficient of friction because the inner cylindrical surface 83 of bearings 70 minimizes friction and wear between bolt 80 and bearings 70 and the side bearing surfaces 84 of bearings 70 minimizes friction and wear between ears 74 and bottom linkage 64. Nylon washers, not shown, are placed between the outer sides of ears 74 and the head of the bolt 80 and the lock nut 82, respectively, to further minimize the friction associated with bolt 80 as top linkage 62 moves with respect to bottom linkage 64.

Figure 6:
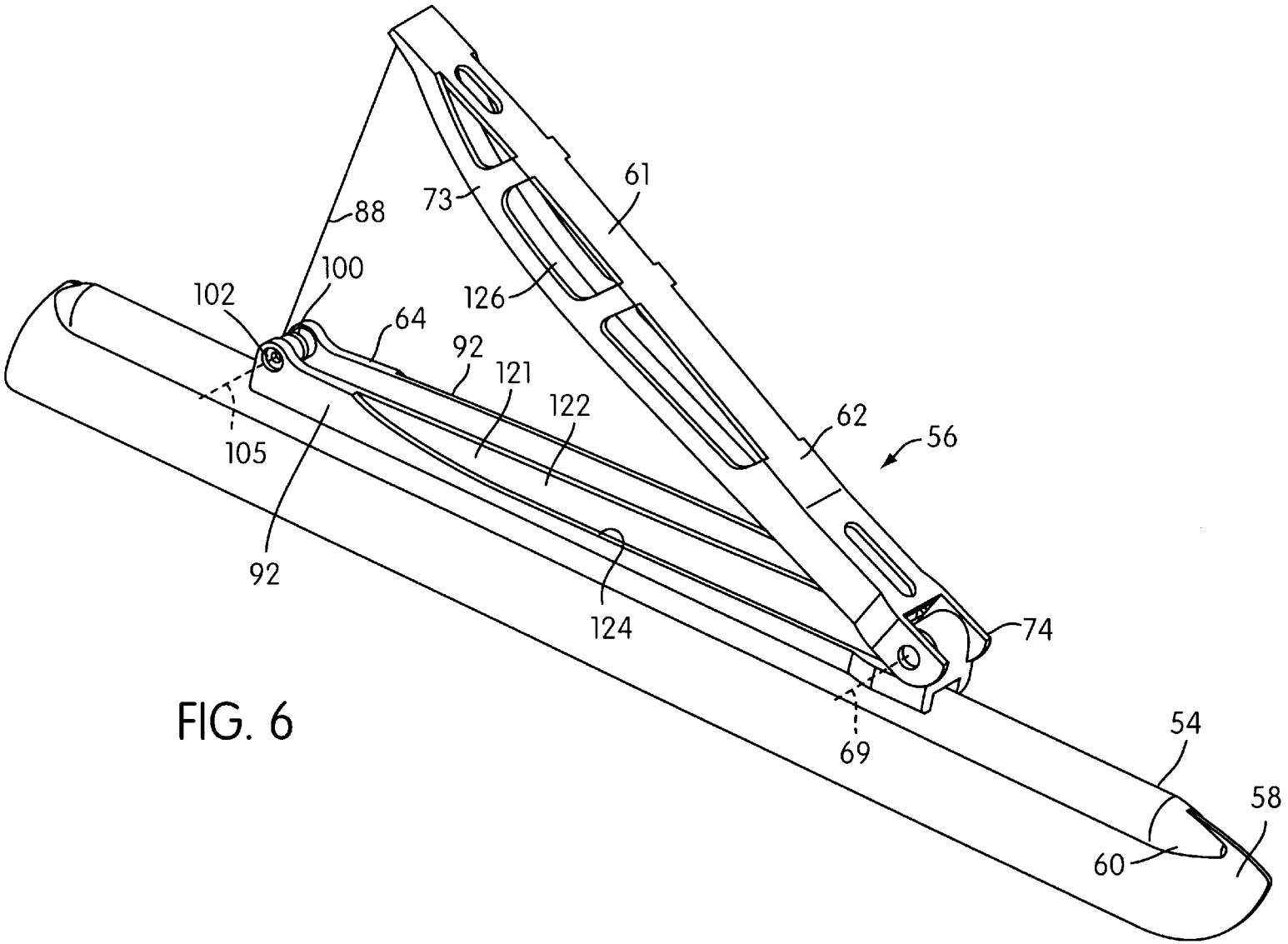
FIG. 6 is front-side perspective view of FIG. 4 shown with the blade and blade holder in an open position with the boot removed.
Figure 8:
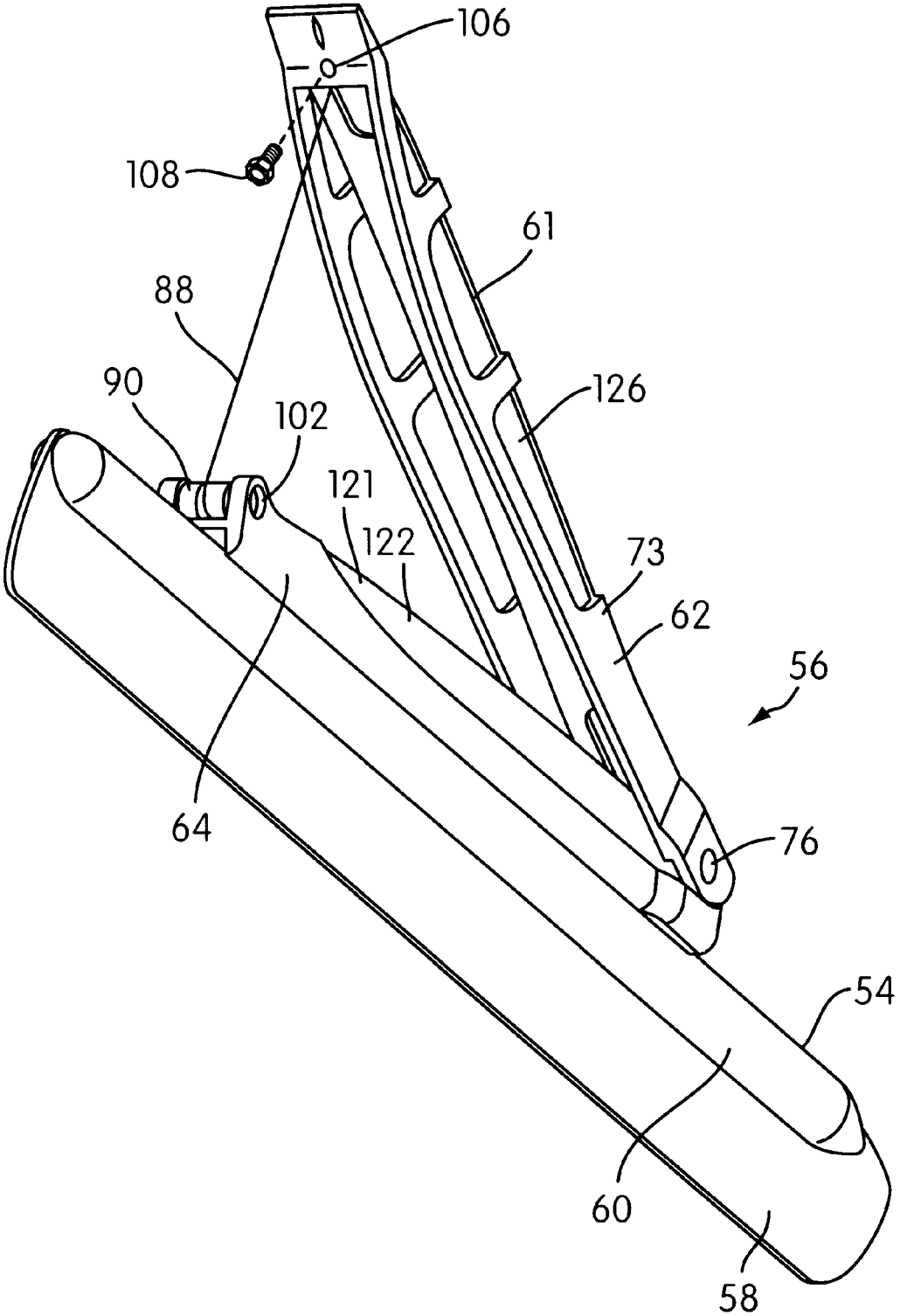
FIG. 8 is rear-side worm's-eye perspective view of FIG. 4 shown with the blade and blade holder in an open position with the boot removed.

The side walls 92 of the bottom linkage 64 guide the side walls 73 of the top linkage 62 as it moves between open and closed positions and form a stop to limit the relative movement of the linkages 62 and 64 as they move into the closed position. As illustrated in FIGS. 6 and 8, the side walls 92 of the bottom linkage 64 have reduced wall sections 121 that are recessed along their length to provide lateral guide surfaces 122 and a bottom ledge 124. Lateral guide surfaces 122 provide lateral guides for the inner surfaces of side walls 73 of top linkage 62. The forward-most portion of the lateral guide surfaces 122 guide the side walls 73 for the entire range of travel and the effective guiding surface area of guide surfaces 122 increases as the blade assembly 54 moves into the closed position. Accordingly, this arrangement enhances the life of the pivot assembly and prevents high transverse torsional forces between the linkages because the torsional forces are transferred between the boot 52 and the blade 58 via the elongated guide surfaces 122 and the side walls 73.

Ledge 124 forms a stop for top linkage 62 and engages the bottom edge of side walls 73 to prevent further relative movement as the unit returns to its closed position. As shown in the drawings, ledge 124 has an arcuate profile along its length and is shaped substantially complimentary to the bottom edge of side walls 73. This arrangement provides an elongated curved stopping area over the length of the bottom linkage 64, and provides for an even contact area and energy transfer between the boot 52 and the blade assembly 54 as they move relative to one another. Moreover, the elongated nature of the ledge 124 results in more evenly distributed forces over the length of ledge 124. This helps to distribute some of the stopping forces to the front of the boot 52 and reduces the highly concentrated loads and shock forces normally transmitted at the heel of the boot 52.

In a preferred embodiment, bottom linkage 64 is made from a strong machinable plastic while top linkage 62 is made from aluminum. This material combination provides a low coefficient of friction between the linkages to reduce wear, while simultaneously providing high strength qualities. Moreover, the combination of materials provides a low clapping sound to reduce distractions. Further, the top linkage 62 preferably includes cut-out portions 126 which reduces the weight of the skate 50.

Figure 7:
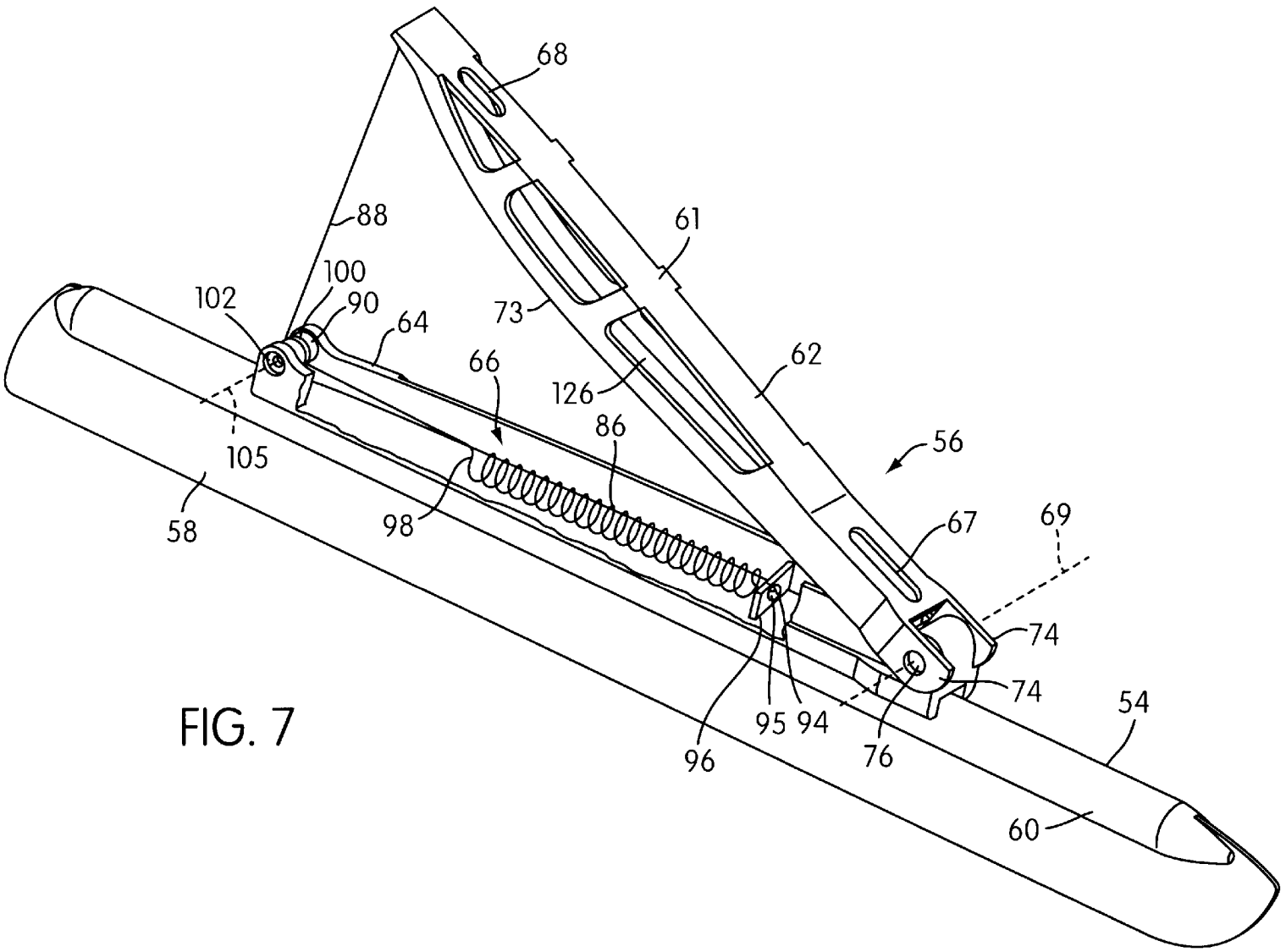
FIG. 7 is a view similar to FIG. 6 with a side wall structure cut-away to reveal the spring and pulley mechanism.
Figure 9:
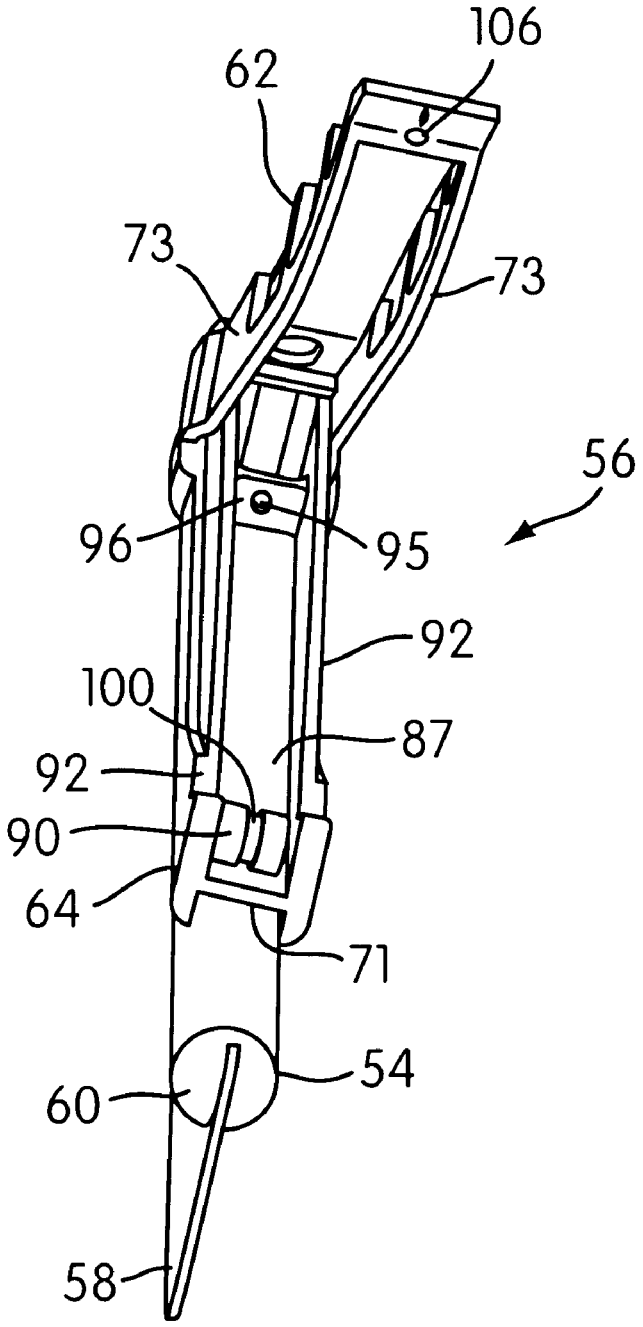
FIG. 9 is rear-side bird's-eye perspective view of FIG. 4 shown with the blade and blade holder in an open position with the boot, spring and cable removed.
Figure 10:
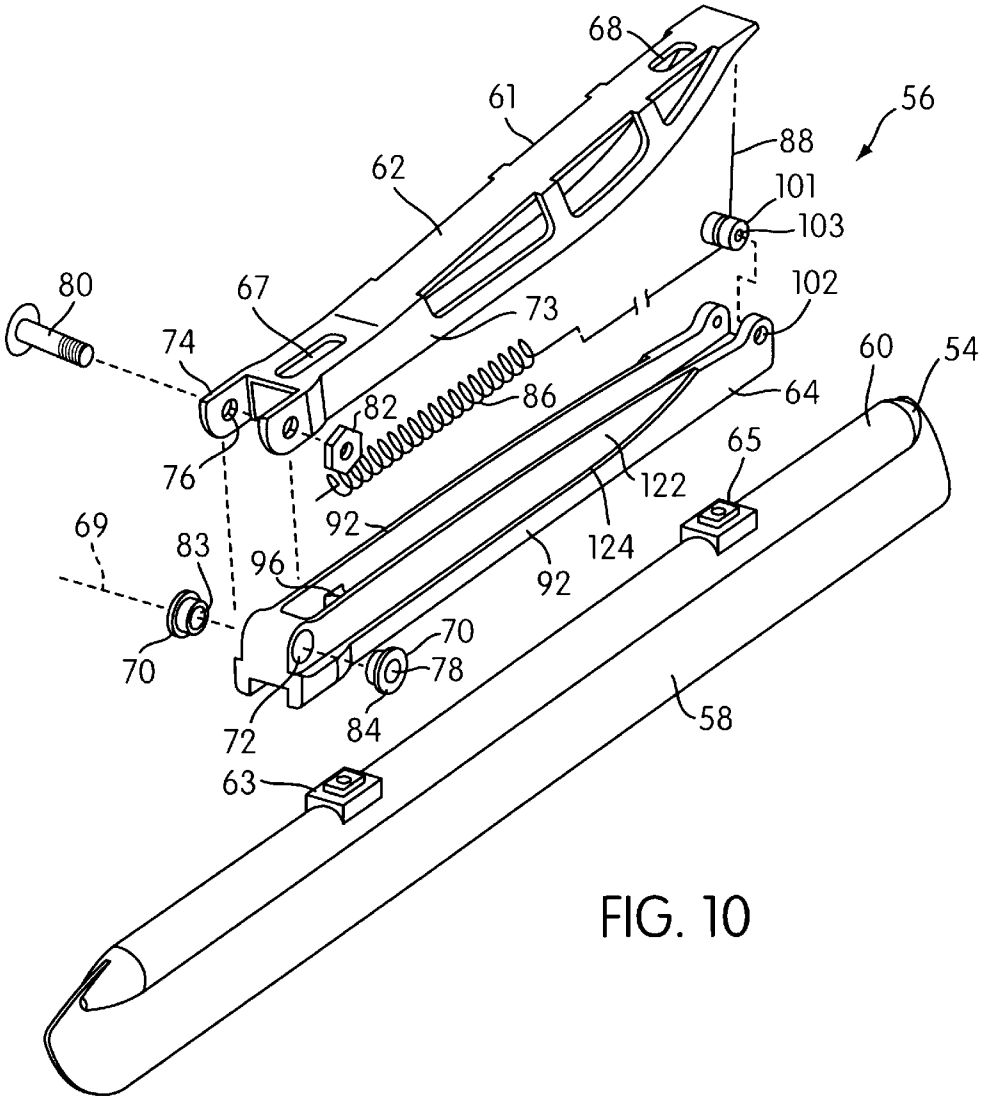
FIG. 10 is an exploded view of portions of FIG. 5.

Absent a thrust force applied by a skater when the skater pivots his ankle, biasing return assembly 66 places the blade assembly 54 in the closed position. Biasing return assembly 66 utilizes a spring 86, a cable 88, and a pulley 90 to accomplish this biasing force. As shown in FIGS. 7 and 9, spring 86 is disposed in a channel 87 created between left and right opposing side walls 92 of bottom linkage 64. Spring 86 includes a hook 94 at its fore end which is inserted into a hole 95 in a transverse rib 96 disposed between opposing side walls 92. The spring 86 hooks around transverse rib 96 between the hole 95 and the top of the rib 96. The aft end 98 of spring 86 is fixedly attached to the fore end of cable 88 in any suitable manner.

Pulley 90 is a cylindrical spool 101 having a recessed groove 100 and a cylindrical bore hole 103 which extends the length of the spool 101. Cylindrical bore hole 103 of spool 101 is placed in alignment with transverse holes 102 adjacent to the aft end of left and right side walls 92 of bottom linkage 64. A through-bolt, not shown, with threads at its end, extends through the aligned holes 102 in side walls 92 of bottom linkage 64 and the hole 103 of spool 101. The through-bolt provides a transverse axis 105 for the spool's rotation. A nylon lock nut, not shown, is threaded onto the bolt to keep it retained in its position. To reduce fiction and provide a reliable system, the spool 101 is preferably comprised of brass which is a high strength, low friction material.

Cable 88 extends rearwardly from spring 86 into the groove 100 of pulley 90, around its transverse rotatable axis 105, and upward to the top linkage 62 where it is attached. Groove 100 retains cable 88 in lateral alignment as the blade assembly 54 repetitively moves with respect to boot 52. To attach the end of cable 88 to top linkage 62, a threaded hole 106 is formed through top wall 61 and the cable 88 is routed through the hole 106. A tightening screw, schematically designated by reference numeral 108, is screwed into hole 106 where it bites into cable 88 and pinches it against the walls of the hole 106 to form the functional end of the cable 88. Excess cable can be cut, capped, wrapped, or otherwise manipulated so not as to interfere with the operation of the device. The tension can be adjusted by loosening the screw 108, adjusting the length of cable 88 between the pulley 90 and hole 106 to the desired length, and re-tightening the tightening screw 108 to form a different effective end of the cable 88. The end portion of the cable 88 can be marked by lines or different colors so the skater knows the relative pre-set tension levels. The adjustable nature of the tension force permits users to adjust the spring tension force based on the ability of skater and the conditions of the ice surface. The cable 88 is preferably made from a TEFLON (i.e., polytetrafluoroethylene) impregnated material, similar to what is used in the biking industry.

However, in lieu of the tightening screw and threaded hole arrangement described above, any other connection method may be used, whether adjustable or not, although it is the adjustability feature is preferred. One such alternative design is shown in FIG. 11. In this cable length adjustment device, top linkage 130 includes an elongated threaded bore 131 having a longitudinal axis parallel to the longitudinal axis of the top linkage 130. A threaded cable ferrule 132 includes an elongated central bore 133 and an enlarged end section 134 with a recessed inner surface 135. The rear end of cable 88 has an enlarged or butted section 136 which is wider than the diameter of elongated central bore 133. Butted section 136 of cable 88 bears against recessed inner surface 135 and keeps spring 86 in a pretensioned position. By turning the ferrule 132 within elongated threaded bore 131, cable 88 can be pulled tighter or loosened against the spring 86 to adjust the biasing force. FIG. 11 also shows the relationship between boot 52, the aft mount 137 on boot 52, and mounting hardware 138 used to attach the top linkage to the boot 52.

As can be seen from the figures, spring 86 and the fore portion of cable 88 are disposed in channel 87 between the side walls 92 of bottom linkage 64. This shields the spring 86 and fore portion of cable 88 from physical damage during transportation and use. Further, the channel and positioning of the spring 86 and the fore portion of cable 88 in a substantially horizontal orientation inside channel 87, which is also substantially horizontal, creates a highly compact and effective arrangement. As the coupling of the cable 88 between the pulley 90 and the top linkage 62 is near the aft of the skate, farthest from transverse axis 69, the spring 86 can be displaced a relatively large amount. This permits the unit to have a high spring tension force and to have the spring tension force be applied in an even and smooth manner. Moreover, because the biasing force is at the rear of the linkages and behind the stopping ledges, the torsional forces will further be minimized.

Figure 5:
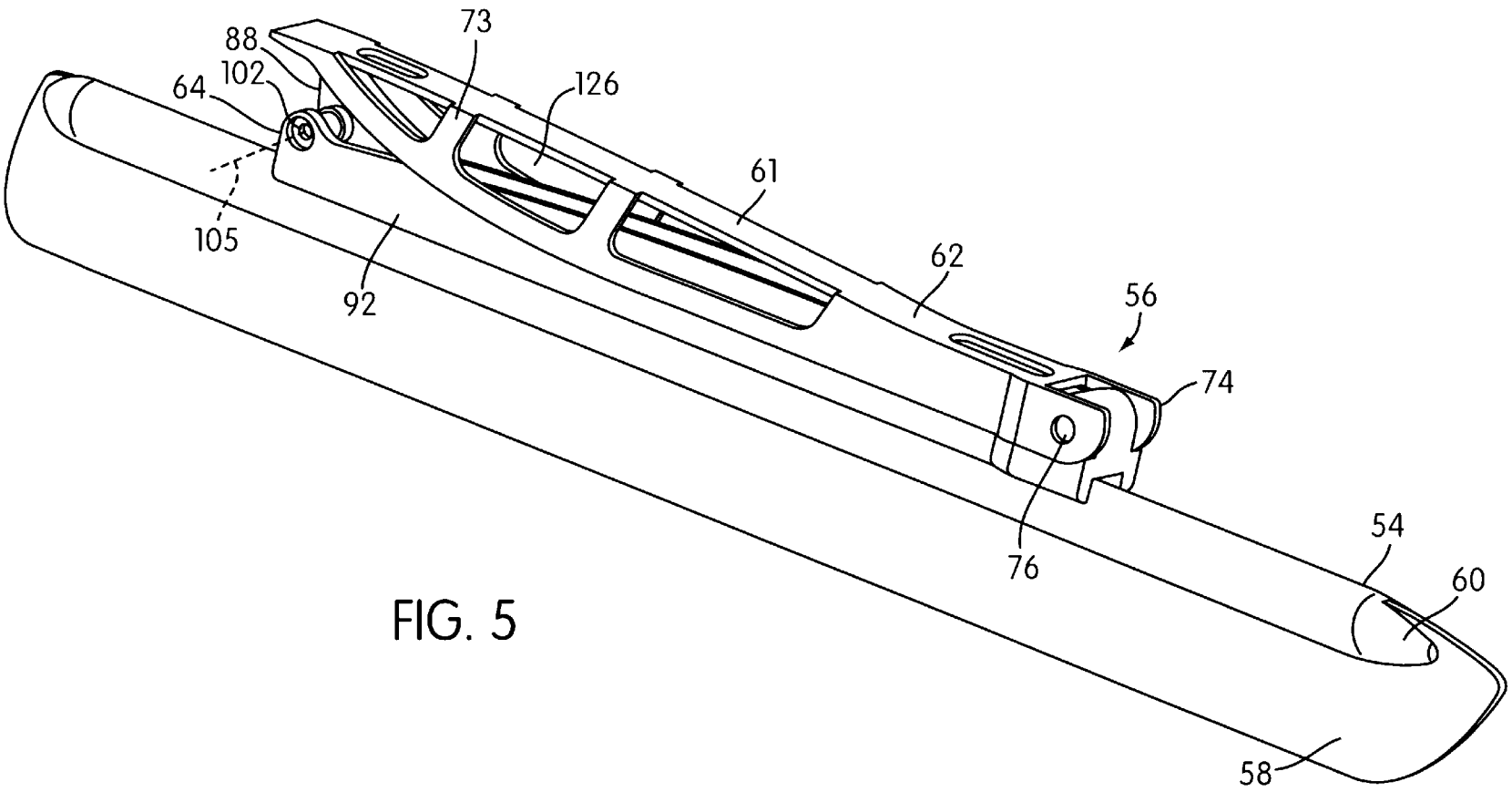
FIG. 5 is front-side perspective view of FIG. 4 shown with the blade and blade holder in a closed position with the boot removed.

In use, the spring 86, cable 88, and pulley 90 arrangement biases the blade assembly to the closed position, as shown in FIGS. 4 and 5. When the skater thrusts his leg outward and pivots his ankle near the end of his stride, the thrusting force will move towards the front of the blade 58 until it shifts front of transverse axis 69. Upon the thrusting force moving forward of transverse axis 69, blade assembly 54 and bottom linkage 64 pivot with respect to top linkage 62 and boot 52 against the biasing force to keep the blade 58 on the ice for the entire length of the skater's stride. When the skater picks his skate up to ready for the next stride, the thrusting force transferred between the boot 52 and the ice, via blade 58, is removed, and the biasing force applied by spring 86 and cable 88 returns the blade assembly 54 to the closed position.

An in-line roller skate featuring the previously described articulating coupling and biasing system is shown in FIG. 11. Accordingly, the primary difference between this skate 150 and skate 50 of FIGS. 4–10, is the supporting surface contacting propulsion unit, which is now a chassis 152 and wheels 154, in lieu of the blade assembly. In a manner well known, wheels 154 are mounted for rotation about individual transverse axes perpendicular to the longitudinal axis of chassis 152. Chassis 152 is preferably mounted to bottom linkage 64 by conventional hardware. In use, skate 150 behaves similar to skate 50 of FIGS. 4–10.

While particular embodiments of the invention have been shown and described, it is recognized that various modifications thereof will occur to those skilled in the art. Therefore, the scope of the herein-described invention shall be limited solely by the claims appended hereto.

I claim:

1. A skate comprising:

a foot holding element, said foot holding element for holding a foot of a skater;

supporting surface engaging means for contacting a supporting surface and transferring a propulsion force applied by the skater from the foot holding element to the supporting surface, said supporting surface engaging means having a longitudinal axis;

a coupling assembly, said coupling assembly coupling the foot holding element and the supporting surface engaging means such that the foot holding element and the supporting surface engaging means are pivotally movable with respect to each other to move the supporting surface engaging means between open and closed positions relative to the foot holding element, said coupling assembly includes first and second linkages pivotally attached to one another;

a biasing device, said biasing device biasing the supporting surface engaging means to move into its closed position, said biasing device including a spring and a cable, said spring having a first end and a second end, said cable having a first end and a second end, said first end of said spring being attached to one of said foot holding element and said supporting surface engaging means, said second end of said spring being attached to said first end of said cable, and said second end of said cable being attached to the other of said one of said foot holding element and said supporting surface engaging means; and a pulley mounted for rotation about an axis transverse to said longitudinal axis, said pulley guiding said cable as the foot holding element moves relative to the supporting surface engaging means between the open and closed positions, said pulley and said spring being positioned within said first linkage.

2. The skate as claimed in claim 1, wherein said spring is entirely positioned within said first linkage.

3. The skate as claimed in claim 1, wherein said first end of said spring is attached to said supporting surface engaging means, said second end of said cable is attached to said foot holding element.

4. The skate as claimed in claim 1, wherein said skate is an ice skate and said supporting surface engaging means includes a blade.

5. The skate as claimed in claim 1, wherein said skate is an in-line roller skate and said supporting surface engaging means includes a plurality of wheels.

6. The skate as claimed in claim, 1, wherein the length of said cable is adjustable to vary the tension of the biasing device.

7. A skate comprising:

a foot holding element, said foot holding element for holding a foot of a skater;

supporting surface engaging means for contacting a supporting surface and transferring a propulsion force applied by the skater from the foot holding element to the supporting surface, said supporting surface engaging means having a longitudinal axis;

a coupling assembly, said coupling assembly coupling the foot holding element and the supporting surface engaging means such that the foot holding element and the supporting surface engaging means are pivotally movable with respect to each other to move the supporting surface engaging means between open and closed positions relative to the foot holding element, said coupling assembly includes first and second linkages pivotally attached to one another; and a spring biasing the supporting surface engaging means to move into its closed position, said spring mounted substantially parallel to said supporting surface and entirely positioned within said first linkage.

8. The skate as claimed in claim 7, further comprising a pulley mounted for rotation about an axis transverse to said longitudinal axis, said pulley guiding said cable as the foot holding element moves relative to the supporting surface engaging means between the open and closed positions.

9. The skate as claimed in claim 8, wherein said pulley is positioned within said first linkage.

10. The skate as claimed in claim 7, wherein said skate is an ice skate and said supporting surface engaging means includes a blade with a bottom surface for contacting the supporting surface, said spring being mounted substantially parallel to the bottom surface of the blade.

11. A skate comprising:

a foot holding element, said foot holding element for holding a foot of a skater;

supporting surface engaging means for contacting a supporting surface and transferring a propulsion force applied by the skater from the foot holding element to the supporting surface, said supporting surface engaging means having a longitudinal axis;

a coupling assembly, said coupling assembly coupling the foot holding element and the supporting surface engaging means such that the foot holding element and the supporting surface engaging means are pivotally movable with respect to each other to move the supporting surface engaging means between open and closed positions relative to the foot holding element, said coupling assembly includes first and second linkages pivotally attached to one another, said first linkage including a pair of sidewalls each having a recessed wall section with respect to a lateral surface on its respective sidewall for providing a guiding surface for the second linkage; and a biasing device, said biasing device biasing the supporting surface engaging means to move into its closed position.

12. The skate as claimed in claim 11, wherein each said recessed wall section further providing a stopping surface for limiting the movement of the second linkage.

13. The skate as claimed in claim 12, wherein each said stopping surface is arcuate in a longitudinal direction.

14. The skate as claimed in claim 11, wherein said first and second linkages are made from different materials.

15. A skate comprising:

a foot holding element, said foot holding element for holding a foot of a skater;

supporting surface engaging means for contacting a supporting surface and transferring a propulsion force applied by the skater from the foot holding element to the supporting surface, said supporting surface engaging means having a longitudinal axis;

a coupling assembly, said coupling assembly coupling the foot holding element and the supporting surface engaging means such that the foot holding element and the supporting surface engaging means are pivotally movable with respect to each other to move the supporting surface engaging means between open and closed positions relative to the foot holding element, said coupling assembly includes first and second linkages pivotally attached to one another, said first linkage including a longitudinally oriented arcuate stopping surface for limiting the movement of the second linkage; and a biasing device, said biasing device biasing the supporting surface engaging means to move into its closed position.

16. The skate as claimed in claim 15, wherein said biasing device provides a biasing force between the first and second linkages aft of said arcuate stopping surface.

17. The skate as claimed in claim 15, wherein said first linkage includes outer sidewalls, said arcuate stopping surface is located on an outer sidewall of the first linkage.

18. A skate comprising:

a foot holding element, said foot holding element for holding a foot of a skater;

supporting surface engaging means for contacting a supporting surface and transferring a propulsion force applied by the skater from the foot holding element to the supporting surface, said supporting surface engaging means having a longitudinal axis;

a coupling assembly, said coupling assembly coupling the foot holding element and the supporting surface engaging means such that the foot holding element and the supporting surface engaging means are pivotally movable with respect to each other to move the supporting surface engaging means between open and closed positions relative to the foot holding element, said coulpling assembly includes first and second linkages pivotally attached to one another;

a biasing device, said biasing device biasing the supporting surface engaging means to move into its closed position, said biasing device including a spring and a cable; and a cable length adjustment mechanism for adjusting the effective length of the cable, said cable length adjustment mechanism includes a cable holding element threadably retained within the first linkage.

19. A skate comprising:

a foot holding element, said foot holding element for holding a foot of a skater;

supporting surface engaging means for contacting a supporting surface and transferring a propulsion force applied by the skater from the foot holding element to the supporting surface, said supporting surface engaging means having a longitudinal axis;

a coupling assembly, said coulpling assembly coupling the foot holding element and the supporting surface engaging means such that the foot holding element and the supporting surface engaging means are pivotally movable with respect to each other to move the supporting surface engaging means between open and closed positions relative to the foot holding element;

a biasing device, said biasing device biasing the supporting surface engaging means to move into its closed position, said biasing device including a spring and a cable;

a cable length adjustment mechanism for adjusting the effective length of the cable;

where said coupling assembly includes first and second linkages pivotally attached to one another, said cable length adjustment mechanism includes a cable holding element threadably retained within the first linkage; and wherein said cable includes an enlarged rear section, said cable length adjustment mechanism includes a central bore, said cable is routed through said bore and retained therein by said enlarged rear section.

* * * * *

UNITED STATES PATENT AND TRADEMARK OFFICE

CERTIFICATE OF CORRECTION

PATENT NO. : 6,007,075
DATED : December 28, 1999
INVENTOR(S) : Albert Shum

It is certified that error appears in the above-identified patent and that said Letters Patent is hereby corrected as shown below:

In the Specification,
Column 6,
Line 9, "awing" has been replaced with --affixing--.

Claim 19, column 12,
Line 30, "where" has been replaced with --wherein--.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*